US006924730B1

(12) United States Patent
Evans

(10) Patent No.: US 6,924,730 B1
(45) Date of Patent: Aug. 2, 2005

(54) FIRE DOOR CONTROL SYSTEM AND METHOD INCLUDING PERIODIC SYSTEM TESTING

(76) Inventor: Rob Jason Evans, 7043 W. Carol Ann Way, Peoria, AZ (US) 85382

( * ) Notice: Subject to any disclaimer, the term of this patent is extended or adjusted under 35 U.S.C. 154(b) by 0 days.

(21) Appl. No.: 10/645,004

(22) Filed: Aug. 20, 2003

Related U.S. Application Data

(63) Continuation-in-part of application No. 10/631,315, filed on Jul. 30, 2003.

(51) Int. Cl.[7] ..... G08B 29/00

(52) U.S. Cl. ..... 340/286.05; 340/506; 340/514; 340/516; 340/526; 340/693.6

(58) Field of Search ..... 340/505–507, 340/514–16, 526–527, 577, 286.01, 309.7, 340/309.16, 331–2, 628, 693.6

(56) References Cited

U.S. PATENT DOCUMENTS

| | | | | |
|---|---|---|---|---|
| 3,803,572 A | * | 4/1974 | Campman | 340/555 |
| 4,002,229 A | | 1/1977 | Washington | 193/34 |
| 4,147,197 A | * | 4/1979 | Bailey et al. | 160/7 |
| 4,671,397 A | * | 6/1987 | Asagi et al. | 477/86 |
| 4,785,293 A | | 11/1988 | Shearer et al. | 340/628 |
| 4,904,880 A | | 2/1990 | Yoshida | 307/66 |
| 4,965,556 A | * | 10/1990 | Brodecki et al. | 340/628 |
| 5,022,452 A | | 6/1991 | Burrell | 160/7 |
| 5,070,442 A | | 12/1991 | Syron-Townson | 700/17 |
| 5,263,527 A | | 11/1993 | Marlatt et al. | 160/7 |
| 5,568,129 A | * | 10/1996 | Sisselman et al. | 340/628 |
| 5,576,581 A | | 11/1996 | Iannuzzi et al. | 307/117 |
| 5,812,391 A | | 9/1998 | Mehalshick | 700/9 |
| 5,850,865 A | | 12/1998 | Hsieh | 160/310 |
| 5,896,907 A | | 4/1999 | Dever et al. | 160/6 |
| 5,950,150 A | * | 9/1999 | Lloyd et al. | 702/183 |
| 6,014,307 A | * | 1/2000 | Crimmins | 361/170 |
| 6,145,571 A | | 11/2000 | Snyder | 160/264 |
| 6,155,324 A | * | 12/2000 | Elliott et al. | 160/1 |
| 6,484,784 B1 | * | 11/2002 | Weik et al. | 160/7 |

* cited by examiner

*Primary Examiner*—Daniel Wu
*Assistant Examiner*—Travis Hunnings
(74) *Attorney, Agent, or Firm*—Schmeiser, Olsen & Watts LLP

(57) ABSTRACT

A fire door control system permits user input during regular use and during alarm conditions. The system utilizes primary and secondary power sources and incorporates a variety of preventive safeguards assuring that functionality of the fire door control system will not be lost. The system utilizes primary power when possible in all alarm conditions. However, during alarm conditions when primary power is lost or when a hand crank hoist remains dangerously engaged, the system is bumplessly connected to a secondary power source and a fire door of the system is closed with the aid of a clutch that directly connects the drive input with an axle that supports the fire door. The clutch pulses on and off to control the descent of the door. The system includes an electronic controller for coordinating the operation of elements of the system and for implementing a method of controlling a fire door system.

17 Claims, 10 Drawing Sheets

FIRE DOOR CONTROL SYSTEM AND METHOD INCLUDING PERIODIC SYSTEM TESTING

CROSS REFERENCE TO RELATED APPLICATION

This application is a continuation-in-part of U.S. patent application Ser. No. 10/631,315, filed Jul. 30, 2003, and entitled "FIRE DOOR CONTROL SYSTEM AND METHOD", by Rob J. Evans, now pending, the disclosure of which is hereby incorporated entirely herein by reference.

BACKGROUND OF THE INVENTION

1. Technical Field

This invention generally relates to a fire door control system and more specifically to a method of controlling a fire door and a fire door control system that remains active before, during, and after an alarm condition. The fire door control system of the present invention maintains control of the fire door in some situations by a clutch.

2. State of the Art

The fire door control systems of the past have largely incorporated fusible links that are activated by the heat of a fire when it reaches the fire door. Thus, the fire doors of the past are generally placed in an irreversible alarm mode that is passive since it does not require or respond to input from a person trying to actively stop or otherwise control the fire door. These fire doors require a specialist to come to the site of the door to reset the door and to set the limits for the system. Other fire doors of the past have incorporated other release means that utilize smoke or heat sensors, and drive motors for moving the fire doors. These doors implement a variety of backup arrangements including secondary power sources for running drive motors, for example. The systems of the past have also implemented a variety of complex mechanisms including brakes and governors for slowing fire doors that are made to fall by their own weight under the influence of gravity.

DISCLOSURE OF THE INVENTION

The present invention relates to fire door systems in general, and specifically to fire door control systems that remain active before, during, and after an alarm condition. In this regard, the fire door control systems of the present invention safeguardedly ensure continual functionality of the systems. Generally, a fire door control system of the present invention provides for actively controlling a fire door in both a regular operational mode and an alarm mode. That is, although the fire door may be controlled automatically by an electronic control system, the fire door may also be actively controlled by pressing buttons that effect certain modes, (such as stopping the fire door, moving the fire door up, and moving the fire door down), for example. The system utilizes primary and secondary power sources and incorporates a variety of preventive safeguards assuring that functionality of the fire door control system will not be lost. The system utilizes primary power when possible in all alarm conditions. However, during alarm conditions when primary power is lost or when a hand crank hoist remains dangerously engaged, for example, the system is bumplessly connected to a secondary power source and a fire door of the system may be closed with the aid of a clutch that may directly connect a drive input with an axle that supports the fire door. The clutch may pulse on and off to control the descent of the door. The bumpless transition includes shifting from connection with a primary power source to a secondary power source without loss of control or function in the system.

The system may also include an electronic controller for coordinating and controlling the operation of elements of the system and for implementing a method of controlling a fire door system. Alternatively, the fire door in accordance with the present invention can be controlled manually by a hand crank hoist in a normal operating mode with the clutch still incorporated to slow the descent of the door under the control of the electronic controller in a fire mode. Furthermore, the fire door can be a door that has no drive mechanism, but which is moved up manually. This door may be designed simply to be lowered in the case of a fire. In any case, the release device including the clutch can be applied to bring the door down.

The fire door system may also include a mechanism for safely closing the fire door and issuing an audible and/or visual warning under alarm conditions. The fire door of the present invention will accept and effect any of a variety of active inputs depending on alarm and non-alarm conditions and the functional state of the system. Furthermore, the fire door control system of the present invention may have many safety features which automatically inform users of failures in the system and of hazards and risks that may be encountered under certain alarm conditions.

In a simple form, a fire door system of the present invention may include a controller, a rollable door, and an input drive for moving the door. The system also may include a clutch connected to the input drive and operatively connected to the controller. The rollable door may be supported by an axle. At least one gear may be connected to the input drive. This gear may be rotatively connected to the axle. However, this gear may also be fixable to the axle by the clutch. Thus, when the clutch is engaged, the gear is fixed to the axle for inputting a drive force from the input drive. When the clutch is disengaged, the axle is free to rotate relative to the gear. Alternatively stated, the axle may be driveably connected to the input drive by the clutch. The axle may rollably support at least the portion of the door. In this way, the axle may rollably receive and feed out sections of the rollable door. Advantageously, the system may further comprise a position limit mechanism connected directly to the axle. The position limit mechanism may register the actual position of the door and not just a movement in the input drive.

The fire door control system may also include a hand crank hoist in addition to a motor for selectively manually controlling movement of the fire door. In one aspect of the invention the input drive includes a hand crank hoist for manually moving the fire door on a system that has no motor. The hand crank hoist may include a hand crank axle with a pulley mounted on a first end and a gear mounted on a second end. An endless element may engage the pulley for manual rotation of the pulley by way of the endless element. A housing may surround the pulley and may also provide a mounting structure for mounting the hand crank hoist on the fire door support structure. The gear mounted on the second end of the hand crank axle may engage a driving element of the fire door system so that the hand crank hoist effectively provides an input drive for moving the door. The hand crank hoist may also include a bell crank mechanism pivotally mounted to the housing. This bell crank mechanism may be engaged by the endless element so that pulling on the endless element in a downward vertical direction rotates the bell crank mechanism relative to the housing. The hand crank hoist may also have at least one shoe selectively engaging a brake element on the hand crank axle. A linkage may connect the shoe to the bell crank mechanism so that movement of the bell crank mechanism moves the linkage, which in turn moves the shoe out of engagement with the brake element and releases the hand crank axle for free movement. Thus, the hand crank axle may be released in response to pulling of the endless element of the hand crank hoist.

The system may also have a variety of sensors. For example, the system may include a hand crank sensor operatively connected to the controller. The hand crank sensor feeds back a signal to the controller indicating that the hand crank hoist is in one of an engaged and a non-engaged position. Other sensors of the system may include a hazardous environment sensor such as a smoke or fire detector. The fire door system may also include a clutch failure sensor, a primary power failure sensor, and secondary power failure sensor. For safety purposes the system may include a safety sensor for detecting an obstruction in the path of the rollable door. Additional sensors may include a motor failure sensor and a spring failure sensor. Each of the sensors of the system provides a feedback signal to the controller and the controller in turn initiates an alert and/or an alarm mode. The alert may be an audio alert, a visual alert, or an audio and a visual alert. Furthermore, the alert may be unique to the particular failure that has occurred. Likewise, the alarm modes may be unique for each of the failures or conditions that have been fed back to the controller. For example, when the safety sensor sends a signal, the controller can automatically bring the door down to a smoke screen level and stop the door for a predetermined period of time to allow disabled individuals to egress before the door closes completely. Appropriate audio and/or visual alerts can accompany this alarm mode. On the other hand, in the case of motor or clutch failure, a different audio alert will be generated calling for appropriate repairs.

One advantage of the present invention is that the system may include a manual alarm switch. This manual alarm switch enables a user to manually test the system to assure that the system is functioning properly and is ready for an unexpected alarm condition. Furthermore, the system can be easily reset by the user. To reset the system, the user simply opens the door to its fully opened position. When the door reaches its fully opened position, a reset switch is actuated and sends a signal to the controller. The controller resets the system by changing the state of the system from any alarm mode that was present previously to a regular operational mode.

While various aspects of fire door systems of the present invention have been described generally above, the clutch of such a system has particular features that advantageously provide for lowering of the door under conditions of loss of primary power and in the case where the hand crank remains engaged during an alarm condition. The clutch may be connected to the secondary power source so that even if power is lost, the door can be shut in a controlled manner with the aid of the clutch. The clutch may have a rotor fixedly supported on the gear which in the present invention may be a sprocket. Thus, the rotor and the sprocket may be fixed together and may be adapted to be rotatively supported on the axle of the rollable door. The clutch may also have an armature including at least one spring supporting a flex plate. The armature also may have a mounting structure that fixedly supports the spring and flex plate on the axle. There may be a small gap between a face of the rotor and a face of the flex plate. The clutch may also have a coil that is supported within the rotor. The coil induces a magnetic field that attracts the flex plate to the rotor against the bias of the spring. Thus, the flex plate can be magnetically and frictionally engaged with the rotor to prevent rotational movement between the flex plate and the rotor. In this engaged condition, the spring substantially rigidly supports the flex plate on the support structure. Therefore, when the clutch is in the engaged condition, the sprocket is substantially rigid with the fire door axle and can hold or drive the axle.

For retrofit applications and for new installations, the clutch can be part of a larger fire door movement control assembly. The fire door movement control assembly may also include a mounting plate that is adapted for mounting the control assembly on support structure for a fire door. The mounting plate may have a through opening sized and positioned to receive the fire door axle therethrough. The mounting plate may also have a mounting platform that supports the controller, which can be an electronic controller, and other electrical components of the fire door movement assembly. This configuration of the clutch, mounting plate, controller, and other electrical components is very advantageous in retrofitting to existing fire doors as an upgrade to those systems. In particular, it is to be understood that any existing drive mechanism including, for example, a motor, a gear box, etceteras, can be used in conjunction with the present invention as long as the drive mechanism is adequate for the weight of the fire door and the wiring is proper and modifiable. Thus, virtually any existing fire door can be upgraded and provided with the advantages of the present invention by retrofitting the present invention to the existing fire door. It is to be noted that since the rotor rotates, the coil cannot easily be mounted on the rotor. Therefore, the fire door movement control assembly may also include coil fastening elements in the form of standoffs that support the coil on the mounting plate.

Whereas systems of the past generally have the drive mechanisms and release mechanisms combined into an integral unit, the system of the present invention lends itself to providing the release mechanism together with the drive mechanism of a new installation or as an upgrade of an existing fire door, which already has a drive mechanism. For upgrades to existing fire doors, the old release mechanisms including fusible links and non-operator controllable lowering mechanisms can be removed and discarded. The release and lowering mechanisms of the present invention can thus replace the release and lowering mechanisms of the past.

The present invention also relates to a method of controlling a fire door system. Generally, a method of controlling a fire door system may include controlling the fire door by an electronic controller during alarm conditions and non-alarm conditions. Accordingly, the fire door may be controlled by a motor during alarm conditions when a primary power source is on. The fire door may be controlled by a clutch during alarm conditions when the primary power source is off or when the system does not include a motor. In any case, the method may include the electronic controller receiving a signal indicating one of the alarm conditions. In response to receiving the signal, the electronic controller may initiate an audio and/or visual alert to inform persons of the alarm condition and to warn them that the fire door will be closing. It should be noted that the audio and/or visual alert can be any one of a variety of specific alerts corresponding to specific alarm events. Furthermore, the electronic controller may be configured to automatically provide a variety of audio and/or visual alerts in response to specific events whether they be alarm events or time sequence events. The method may also include receiving any of a plurality signals from sensors in the system as has been discussed above. To this end, the method may include providing a variety of alerts and/or time delays in response to specific corresponding input signals to the electronic controller.

An advantage of the method is that the fire door system of the present invention does not require a specialist to come to the site of the fire door, test it, and reset it. A fire door associated with the present invention is easily tested and reset by an employee or facility owner. The system can be reset simply by removing an alarm condition. In some cases resetting the system may require the steps of removing an alarm condition and resetting the system. This can be achieved by simply opening the door after it has been lowered in an alarm condition. During testing or an actual emergency event, the end limits of motion are never lost during closure of the fire door with the present invention because the limits are connected directly to movement of the door. Thus, the fire door of the present invention need not remain inoperable while awaiting service from the specialist after an emergency event. That is, the fire door does not cause "down time" while awaiting a specialist to come re-engage the drive mechanism, reset the limits, reset the pulleys, replace the fusible links, and tie the release mechanism to a mounting device as required by systems of the past.

Another advantage gained by this aspect of the present invention is that the present system can also include alerts to remind the occupants/business owners to test the door every six months in accordance with FM and UL requirements. Additionally, after a year of no testing, the system can automatically go into a lockout mode in order to require testing of the fire door before the alert is silenced. Thus, the system prompts a user to test the system, which can be easily tested by the user without requiring a specialist to come in for resetting the system and limits for the door. Therefore, the system can save much time and expense. Alternatively, the system and method can be configured to automatically test the fire door system periodically.

The method may also include effecting a bumpless shift from primary power to secondary power by the electronic controller when loss of the primary power occurs. Furthermore, the method may include periodically checking for each of a loss of primary power, a failure in the secondary power source, and a field breakdown in the clutch.

The method also may include resetting the electronic controller by opening the fire door to a fully open position. Resetting the electronic controller may also include removing any alarm condition in the system for subsequent regular, non-alarm operation of the fire door system. The method also includes the steps of controlling the fire door by pressing buttons operatively connected to the electronic controller to actively open, close, or stop the fire door.

The foregoing and other features and advantages of the present invention will be apparent from the following more detailed description of particular embodiments of the invention, as illustrated in the accompanying drawings.

DETAILED DESCRIPTION OF EMBODIMENTS OF THE INVENTION

Figure 1:
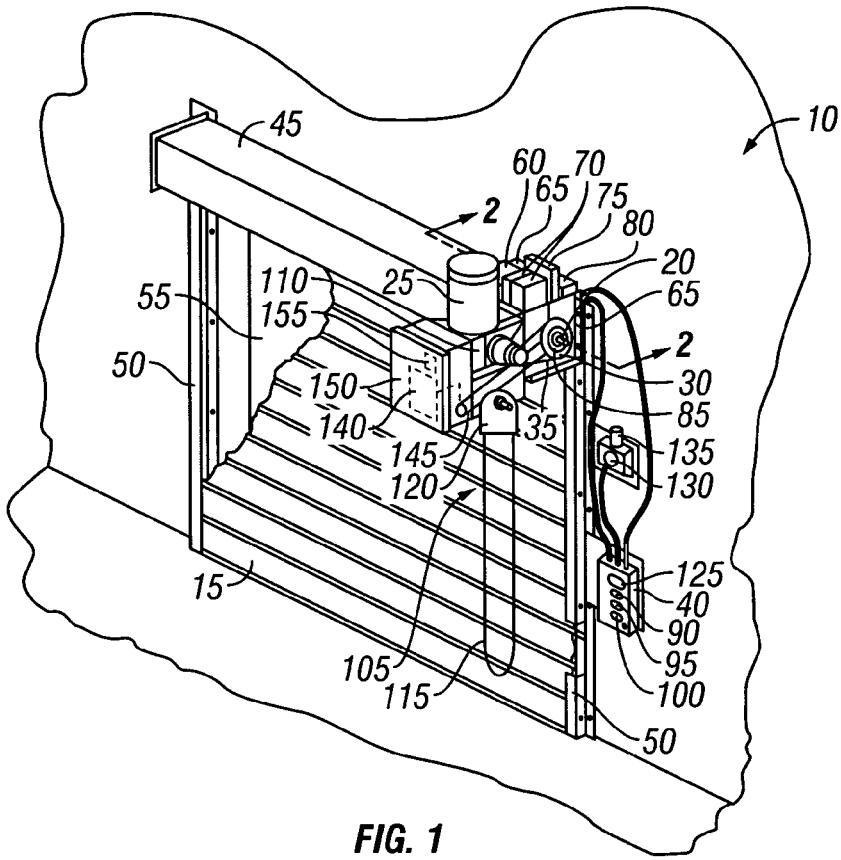
FIG. 1 is a perspective view of a fire door incorporating a first embodiment of a fire door control system of the present invention.

FIG. 1 is a perspective view of a fire door incorporating a fire door control system 10 in accordance with an embodiment of the present invention. The fire door includes a rollable door 15 supported on an axle 20. The axle 20 is rotated by a drive input comprising a motor 25 that drives a sprocket 30 by a chain 35. The motor 25 is controlled by pressing buttons on a user interface device in the form of a control panel 40. Alternatively, the user interface device could include radio controls, for example, on a remote control device. Some examples of communications connection may include, without limitation, electronic or other data transferring cable (including optical as well as electrical), radio frequency wave transmissions including cellular frequency transmissions as well as microwave, satellite dish frequencies, etc., phone lines (again both optical and electrical), "Bluetooth" technology transmissions, and the like, such as is common with remote communication systems.

All or part of the rollable door 15 is stored in a door hood 45. As such, the fire door of the present invention is selectively slid upwardly or downwardly in tracks 50 to open and close an opening 55 similar to a regular service door. However, the fire door of the present invention additionally has a fire door control system 10 that includes elements that enable the fire door system to function as a fire door. Yet, the fire door control system 10 permits active control of the door 15 even in an alarm condition. For example, a user temporarily halt the door from going down by pressing and holding a stop button 100.

To control and coordinate the many functions in the system, the fire door control system 10 includes an electronic controller 60 supported on a plate 65. The plate 65 also supports a secondary power source including batteries 70, a transformer/analog to digital converter 75, and a relay terminal box 80. As shown in FIG. 1, the mounting plate 65 forms a mounting platform on an upper portion thereof. The mounting plate 65 is bent at a right angle and a vertical portion thereof extends downwardly on a right hand side of the fire door. The downwardly extending vertical portion of the mounting plate 65 has a through opening therein (not shown) through which the fire door axle 20 extends. Thus, the sprocket 30 can be mounted exteriorly of the hood 45 and the vertical portion of the mounting plate 65 as shown in FIG. 1. The mounting plate 65 can be mounted on existing fire door support structure along a right edge of the downwardly extending vertical portion of the mounting plate 65 as shown in FIG. 1. Thus, the mounting plate 65 provides an advantageous structure for easily retrofitting the fire door control system on an existing fire door.

The fire door control system 10 of the present invention advantageously includes a clutch 85 that is connected to the fire door axle 20 and to the sprocket 30 as will be described in greater detail below. The clutch 85 regularly holds the sprocket 30 in rigid driving relation relative to the fire door axle 20 so that when an up button 90, a down button 95, or a stop button 100 of the control panel 40 are pressed, the motor 25 effectively controls the axle 20.

Additionally, a hand crank hoist 105 is connected to a gear box 110 associated with the motor 25. As such, the hand crank hoist 105 forms part of an input drive. In order for the hand crank hoist 105 to be used, a lever (not shown) or a solenoid inside the gear box 110 must engage the hand crank hoist 105 with a gear of the input drive. In this state, it would be dangerous to run the motor 25 because an endless element 115 of the hand crank hoist would be severely whipped about and through a housing 120. Thus, there needs to be some safety provisions in the fire door control system 10 to prevent inadvertent operation of the motor 25 when the hand crank hoist 105 is engaged. For this purpose, a micro-switch 155 is actuated when the hand crank hoist is engaged, and the micro-switch sends a signal to the electronic controller 60. In response, the electronic controller operates the clutch 85 instead of the motor 25 during an alarm condition when the hand crank hoist 105 remains engaged.

The electronic controller 60 initiates an alert when an alarm event is experienced. An alarm event or condition is experienced when a signal is received by the electronic controller 60 from any one of a plurality of sensors in the system. Alternatively, and advantageously, an alarm switch 125 located on the control panel 40, for example, can be manually actuated. The alarm switch 125 is actuated, for example, when a user wishes to test the fire door system 10. Thus, the user can test the fire door system 10 to determine if the fire door will operate correctly in an alarm condition. In either case, when a signal indicating an alarm condition is received by the electronic controller 60, the electronic controller initiates an alert. This alert can be an audio alert transmitted over a speaker 130 and/or a visual alert in the form of a flashing strobe 135, or the like.

In an alarm condition, the rollable door 15 is brought down. Whether brought down by the motor 25 or under the control of the clutch 85, the position of the door 15 is monitored by a position limit mechanism 140. The movement of the door 15 is conveyed to the position limit mechanism 140 by a chain 145 connected to the axle 20 as shown in FIG. 1. The position limit mechanism 140 can be a conventional mechanism. However, an input to the position limit mechanism is provided directly from the axle 20 by the chain 145. In this way, whether the door position is being controlled by the motor 25 or by the clutch 85, the position of the door 15 will be registered accurately by the position limit mechanism 140. The position limit mechanism 140 is housed in a box 150 mounted to the motor gear box 110. This box 150 also houses the micro switch 155 that is operatively connected to an engagement mechanism of the hand crank hoist 105 as described above.

While the endless elements 35, 115, 145 have been shown generically and described in some cases as chains, it is to be understood that these elements could be provided as any of a variety of chains, belts formed of rubber or composite material, or any other endless driving element without departing from the spirit and scope of the invention. Furthermore, the endless element 35, 115, 145 of the present invention could be replaced by shafts with geared or other inputs without departing from the spirit and scope of the invention.

When primary power is on and the hand crank hoist 105 is not engaged, the fire door control system 10 regularly moves the door 15 by the motor 25 even when a alarm condition has been sent to the electronic controller 60. However, if the primary power is lost and an alarm condition is received by the electronic controller 60, then the electronic controller 60 brings the door 15 down by operatively controlling the clutch 85. Likewise, if the hand crank hoist 105 is engaged and an alarm condition is received, then the electronic controller 60 brings the door 15 down by operatively controlling the clutch 85. This is achieved by pulsing the clutch 85 on and off into and out of an engaged condition in a repeated manner to allow the door 15 to drop in short increments. In this regard, it should be noted that the door 15 will go down under the influence of gravity by itself. To prevent the door 15 from going down too rapidly, the clutch 85 is engaged in this pulsed manner so that the speed of the door 15 is slowed or stopped at intervals corresponding to the pulses. Thus, the speed of the door 15 remains less than or equal to a predetermined maximum. The engagement of the clutch 85 and the relationship of the clutch 85 to other structures of the system 10 will be described in greater detail with regard to FIG. 2A below.

Figure 2A:
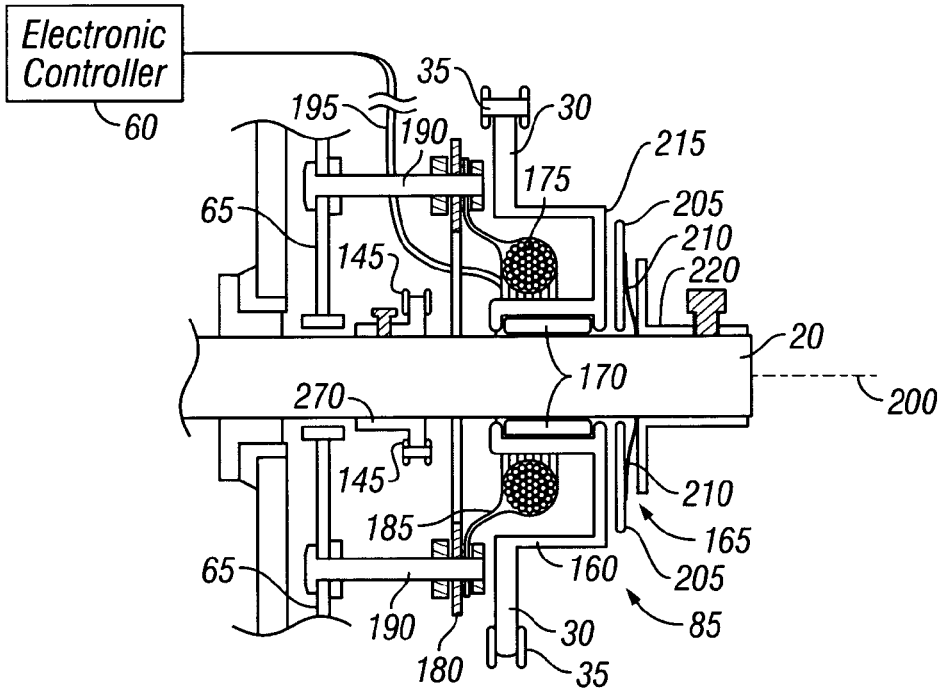
FIG. 2A is a sectional view of a clutch as taken along lines 2—2 of FIG. 1.

FIG. 2A is a sectional view of the clutch 85 supported on the rollable door axle 20. The clutch includes a rotor 160 fixed to the sprocket 30 and an armature 165 fixed to the axle 20. The rotor 160 and the sprocket 30 are rotatively supported on the axle 20 such as by a bearing 170. The coil 175 is supported within the rotor 160 as shown in FIG. 2A. The coil 175 is supported such as by a frame 180 and a band 185. The frame 180 and coil 175 are held at the proper position within the rotor 160 by standoffs 190. The standoffs 190 are mounted on the downwardly extending vertical portion of the mounting plate 65. Thus, the coil 175 remains stationary relative to the mounting plate 65 and the other fire door support structure. On the other hand, the rotor 160 can rotate freely about the door axle 20 when the clutch 85 is disengaged, and the rotor 160 and armature 165 rotates together with the axle 20 when the clutch 85 is engaged.

In order to fix the sprocket 30 relative to the axle 20, the clutch 85 must be engaged. To accomplish this, a current is fed to the coil 175 by way of electrical line 195. Current in the coil 175 induces a magnetic field generally along an axis 200 of the axle 20. The magnetic field attracts and pulls a flex plate 205 against the bias of spring 210.

The flex plate 205 is pulled into engagement with a face 215 of the rotor 160 and frictionally holds the rotor 160 against rotational movement together with the flex plate 205. As can be seen in FIG. 2A the spring 210 supports the flex plate 205 somewhat rigidly on a mounting structure comprising a sleeve 220. As can be appreciated, if power is pulsed on and off through line 195, then the flex plate 205 will be repeatedly engaged and disengaged with the face 215 of the rotor 160. Thus, the door 15 will be permitted to fall during short periods of time between which the flex plate 205 will engage the rotor 160 and inhibit rotation of the axle 20 relative to the rotor 160. Therefore, movement of the door 15 will also be inhibited in pulses. It is to be understood that the sprocket 30 and axle 20 are held against movement, when the clutch 85 is engaged, by the chain 35 when the motor 25 is not running. This is because of the gear reduction in the gear box 110 is high, (e.g. approximately 40 to 1). Thus, the motor 25 cannot be back driven. However, in an alarm condition with no primary power, or when the hand crank hoist 105 is engaged, the fire door control system 10 can easily disengage the clutch 85 in pulses and thereby permit the door 15 to fall in controlled increments until the door 15 is completely closed.

Figure 2B:
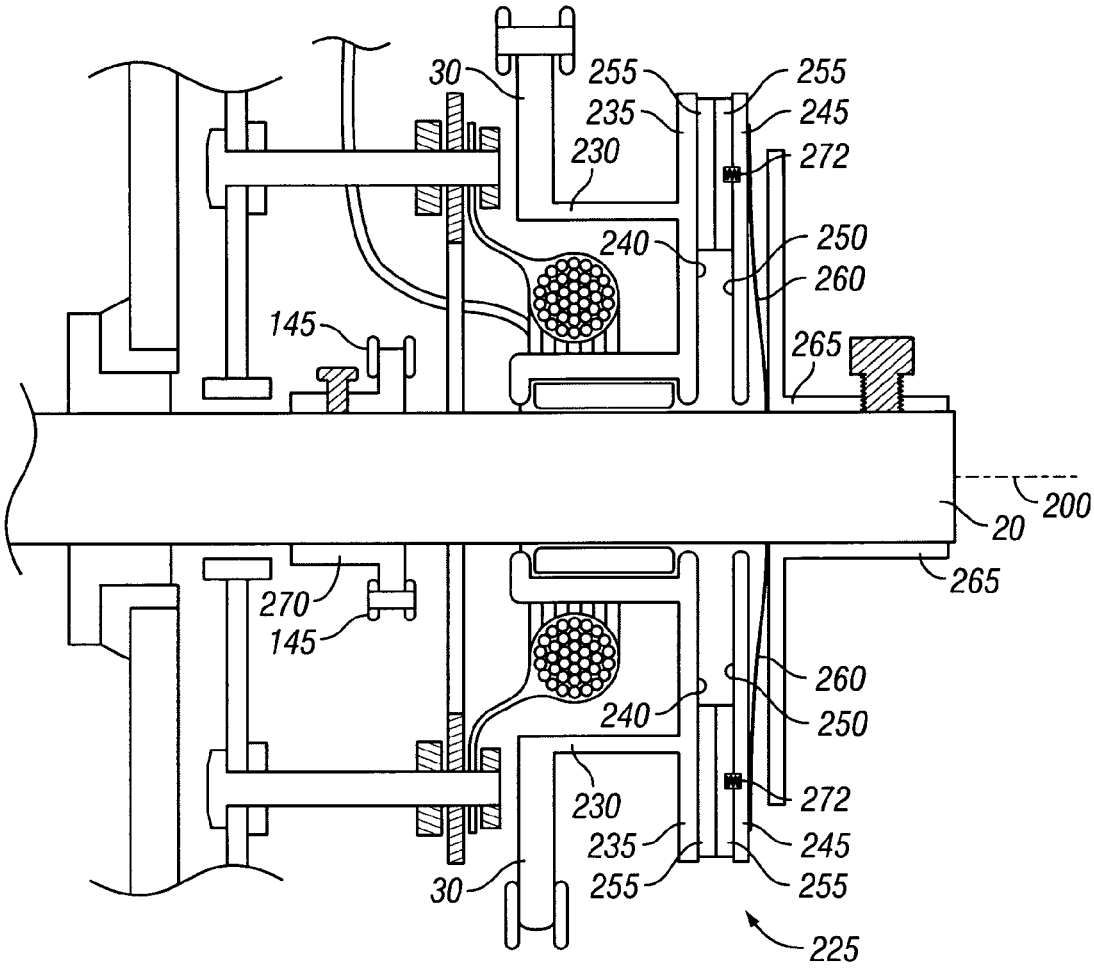
FIG. 2B is a sectional view similar to FIG. 2A in accordance with a second embodiment of the clutch.

FIG. 2B is a sectional view of a clutch 225 in accordance with an alternative embodiment. As can be appreciated, the clutch 225 is substantially similar to the clutch 85, distinctions being the size of the rotor face and a corresponding size of the flex plate as described in greater detail hereafter. The rest of the clutch 225 is generally the same as the clutch 85 of FIG. 2A. The clutch 225 of FIG. 2B takes advantage of providing frictional engagement at a larger radius to provide greater torque when the clutch 225 is engaged. To this end, the rotor 230 has an extended plate or friction disc 235 providing an engagement face 240 that extends radially outward from the axis 200 a distance greater than the rotor 160 of clutch 85. Likewise, a flex plate 245 extends radially outward to provide a similarly extending engagement face 250 on the flex plate 245. Each of the engagement faces 240 and 250 can have a wear pad or friction plate or ring 255 secured thereon to face each other and engage when the clutch 225 is engaged. The wear pads 255 in FIG. 2B, (or the rotor face 215 and the flex plate 205 in FIG. 2A), can be separated a distance of approximately twenty thousandths of an inch when the clutch 225 is not engaged. Other distances may be implemented as needed. Alternatively, the wear pads 255 can be supported by springs 272 on the rotor 230 and/or the flex plate 245 in order to provide a pretensioned engagement between the wear pads 255. Thus, in the unlikely event that both the primary and secondary power sources are lost, the wear pads 255 would provide an additional door control mechanism for impeding the speed of descent of the door 15 by the friction between the wear pads 255. As can be noted from FIG. 2B, these wear pads 255 are at a greater radius than the engaging surfaces of the flex plate 205 and rotor 160 in FIG. 2A. Thus, a greater torque is experienced by the extended plate 235 of the rotor 230. The result is that clutch 225 of FIG. 2B has greater holding strength for the same amount of current in the coil 175 as that of the clutch 85 of FIG. 2A. Similar to the clutch 85, the clutch 225 of FIG. 2B has a spring 260 supporting the flex plate 245 on a mounting structure comprising a sleeve 265.

The diameters of the extended plate 235 and the flex plate 245 can be selected to be of any size from nearly zero up to approximately thirty-six inches. Typically, diameters in a range from approximately eight inches to approximately thirty-six inches will be effective. The diameters of the rotor 160 and flex plate 205 of FIG. 2A are typically in a range from about three inches to about eight inches. In principle, the diameters of the rotor 160 and flex plate 205, 245 are selectively increased as the weight of the fire door 15 to be controlled is increased so that the clutch 85, 255 can more easily handle the increased torque. It should also be noted that the clutch 85, 255 is adjustable so that the magnetic attraction and static torque capabilities can be adjusted. For example, the magnetic attraction and accompanying force can be increased by increasing the current in the coil 175. This can be accomplished by a rheostat or a voltage pot in the electronic controller 60, whereby the voltage to the coil 175 can be adjusted in a range from approximately twelve volts to approximately one hundred and twenty volts, for example. Thus, a user can select the strength of the clutch 85, 255 for inhibiting relative movement between the axle 20 and the sprocket 30 by adjusting the clutch 85, 225.

Additionally, or as a further alternative to the additional door control mechanism provided by the springs 272 described above, a purely mechanical clutch could be supplied for safety purposes. This mechanical clutch can be a fluid or a centripetal clutch that is additional to the clutch 85 or clutch 225, in case the clutch 85 or the clutch 225 fails. This mechanical clutch would thus act to slow or stop the descent of the door if the electromechanical clutch were to fail and the door were to begin to accelerate under the influence of gravity.

FIGS. 2A and 2B also make clear the connection of the position limit chain 145 to the fire door axle 20. As can be seen, a combination sleeve and sprocket element 270 is fixed to the axle 20 between the sprocket 30 and the mounting plate 65.

Figure 3A:
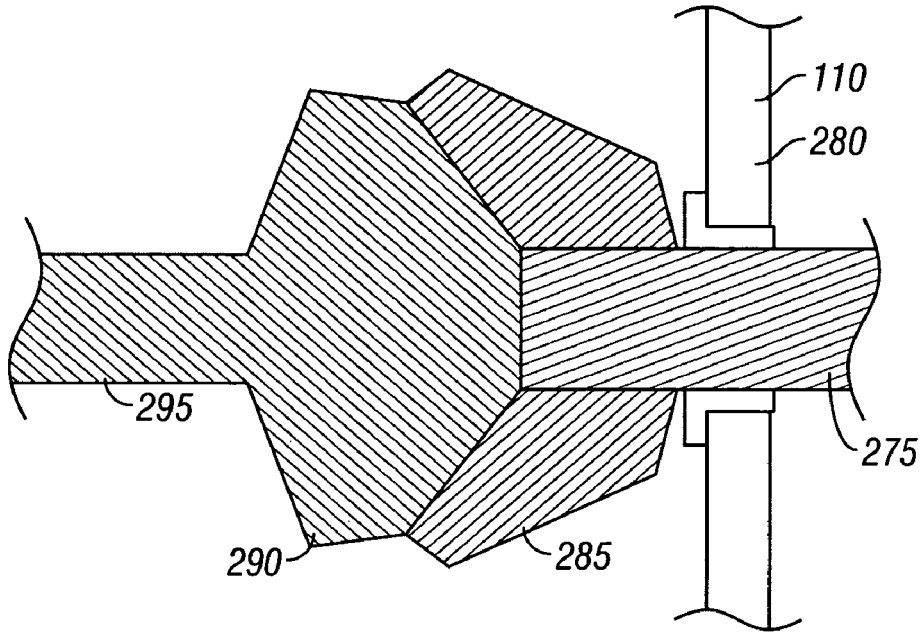
FIG. 3A is a sectional view of the hand crank axle and drive gear in an engaged condition.
Figure 3B:
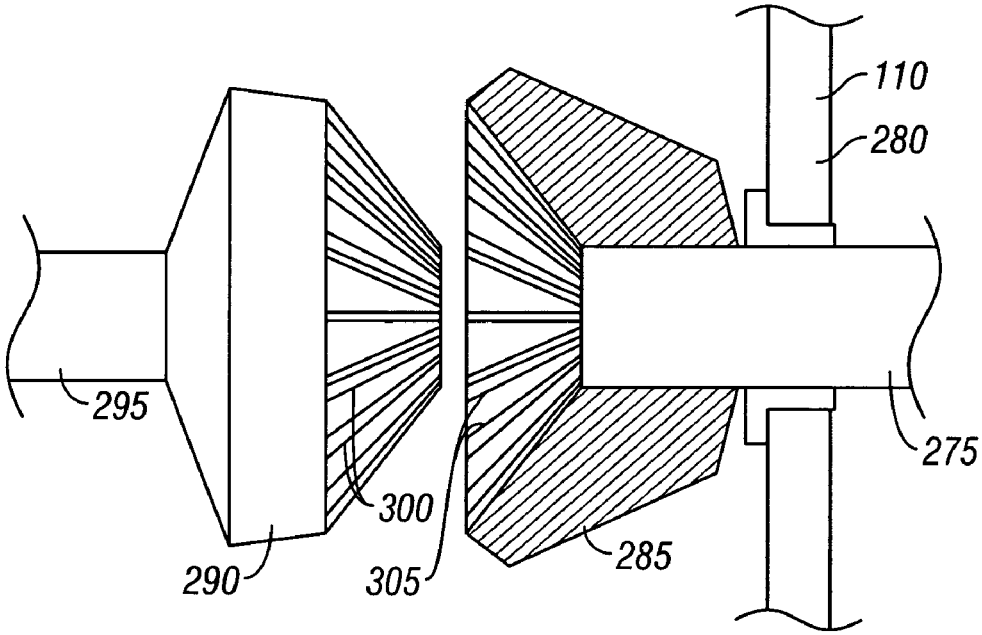
FIG. 3B is a partial sectional view similar to FIG. 3A with the hand crank hoist axle and gear in a disengaged condition.

FIGS. 3A and 3B show the engagement mechanism for drivingly engaging the hand crank hoist 105 to the drive mechanism of the fire door control system 10. FIG. 3A is a cross sectional view showing a hand crank axle 275 supported in a wall 280 of the gear box 110 of the motor 25. The hand crank axle 275 has a gear 285 fixed on an end thereof interiorly of the gear box. A mating gear 290 is fixed on the end of a drive shaft 295 that is motively connected to the fire door axle 20. In FIG. 3A the hand crank hoist 105 is in an engaged condition with the mating gear 290 moved into engagement with the gear 285.

FIG. 3B is a partial sectional view similar to FIG. 3A and shows the mating gear 290 in a disengaged position. Each of gears 285 and 290 have mating structure comprising spines and grooves 300 and 305 respectively. Thus, in the engaged condition, no relative movement takes place between the hand crank axle 275 and the drive shaft 295. It is to be understood that the drive shaft 295 and the mating gear 290 can be moved by a lever or other manually manipulable mechanical device. Alternatively, the drive shaft 295 and mating gear 290 can be moved by a solenoid or some other automatic mechanism, which can be controlled by the electronic controller 60. As such, a position sensor can be provided to sense the position of the drive shaft 295 and feed a corresponding signal to the electronic controller 60. Alternatively, the position of drive shaft 295 and the mating gear 290 can be represented by the state of the elements controlling the movement of the drive shaft 295 in the electronic controller 60. In any event, a signal representing the position of the drive shaft 295 and the condition of the hand crank hoist 105 is provided in the electronic controller 60 to prevent running of the motor when the hand crank hoist 105 is engaged.

Figure 4:
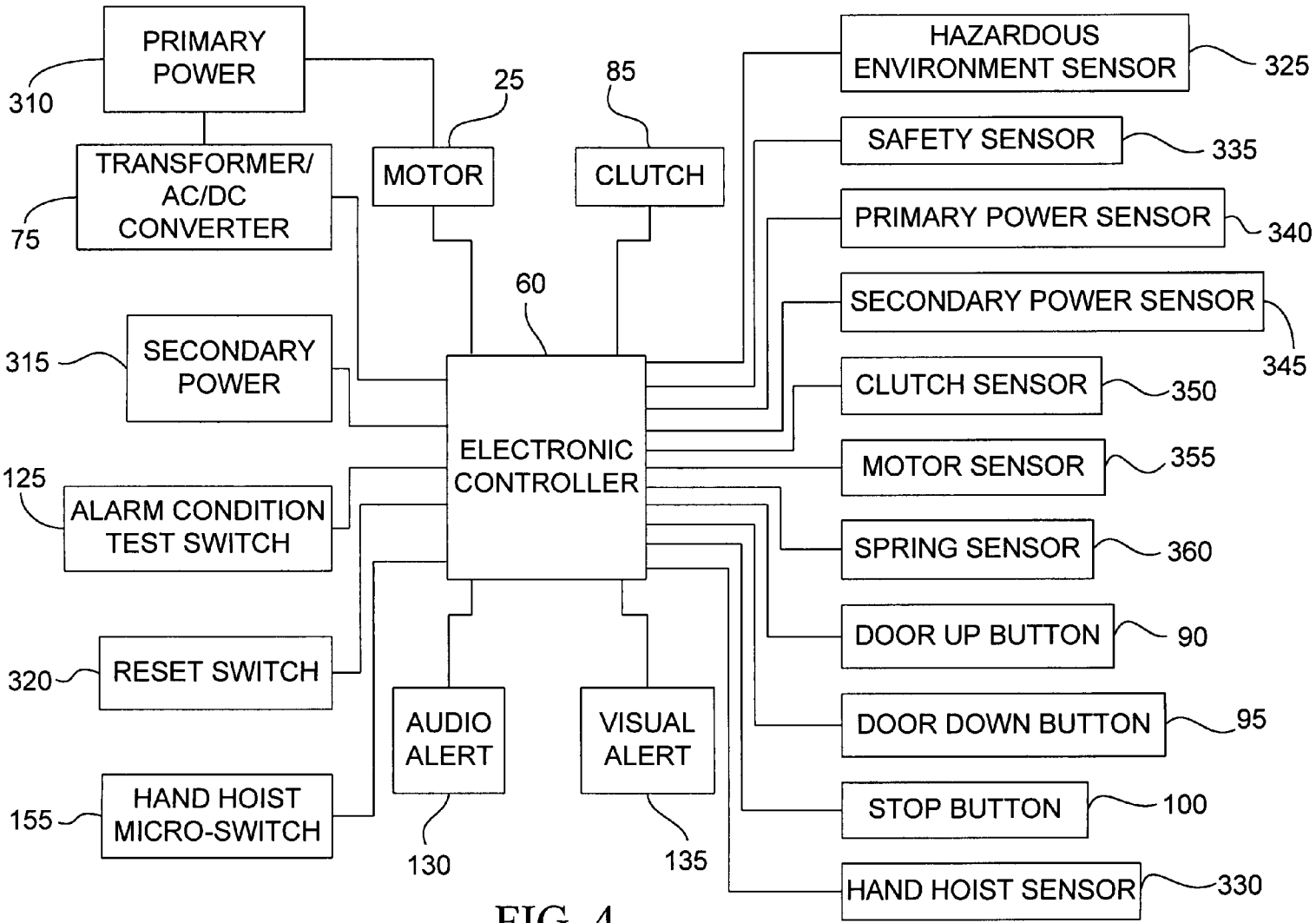
FIG. 4 is a block diagram of the electrical components of the fire door control system.

As made clear from the foregoing description, all of the electrical components of the system are operatively connected to the electronic controller 60. FIG. 4 is a block diagram showing these various electrical components connected to the electronic controller 60. The motor 25, the transformer/analog digital converter 75, the clutch 85, the door up button 90, the door down button 95, the door stop button 100, the alarm condition test switch 125, the hand hoist micro switch 155, the audio alert speaker 130, and the digital alert strobe 135 have been described to some degree above. Each of these elements includes electrical aspects which are operatively connected to the electronic controller 60. Primary power 310, secondary power 315, and the reset switch 320 were described above but are shown and labeled in FIG. 4 as being operatively connected to the electronic controller 60. Likewise, the hazardous environment sensor 325 and the hand hoist sensor 330 were described above but are labeled and shown in FIG. 4 as being operatively connected to the electronic controller 60. FIG. 4 also shows a safety sensor 335, a primary power sensor 340, a secondary power sensor 345, a clutch sensor 350, a motor sensor 355, and a spring sensor 360 each operatively connected to the electronic controller 60. Each of the sensors provides feedback to the electronic controller 60. The electronic controller 60 in turn implements some action such as initiating an audio alert or waiting a predetermined period of time before implementing a subsequent action such as initiating an alarm condition.

It is to be understood that the sensors need not be separate sensors, but any sensors according to the invention may comprise: 1) signals from the various components; 2) the value of those signals; and/or 3) switching in the electronic controller 60. Furthermore, it is to be understood that the electronic controller can take any of several forms including, but not limited to, a programmable logic controller (PLC), a computer under software control, and one or more logic boards. In one configuration the electronic controller 60 comprises an AC logic board and a DC logic board. These boards can be structurally and/or electrically connected so as to provide the electronic controller 60 as a unit. It should be noted that the power supply can be provided in a variety of forms. In particular, the primary power source can be provided at voltages in a range from approximately twelve to five hundred seventy-five volts, depending on the needs in the system 10.

For the exemplary purposes of this disclosure, in one application the primary power is supplied to first and second logic boards. The primary power may be supplied as a one hundred twenty volt or two hundred twenty volt single phase supply, and the primary power may also supplied to a second logic board as two hundred and eight, two hundred and thirty, four hundred and eighty, or five hundred and seventy-five volt three phase power. Notwithstanding, power can be supplied in other forms that are currently known or that may be discovered without departing from the spirit and scope of the invention.

Figure 5:
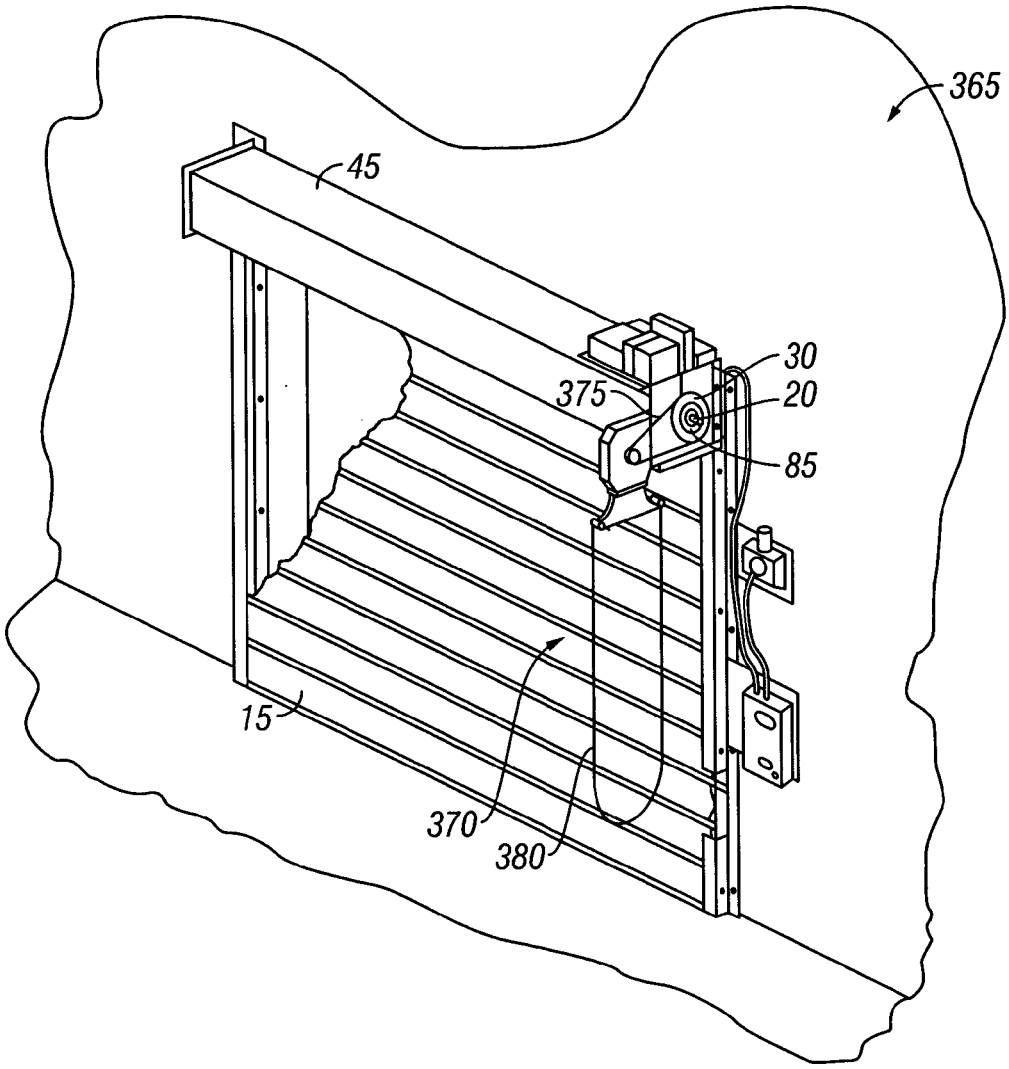
FIG. 5 is a perspective view similar to FIG. 1 incorporating a second embodiment of the fire door control system in accordance with the present invention.

FIG. 5 is a perspective view similar to FIG. 1, but showing a fire door control system 365 configured according to another embodiment of the present invention. Notably, the system 365 of FIG. 5 does not have a motor 25. Rather, the input drive is in the form of a hand crank hoist 370 connected to the system 365 in a position similar to the hand crank hoist 105 of FIG. 1. However, the hand crank hoist 370 of FIG. 5 is directly and motively connected to the sprocket 30 by a drive chain 375. Other than the substitution of the hand crank hoist 370 for the overall input drive of the system 10 of FIG. 1, and details of the hand crank hoist 370 to be described below, the system 365 of FIG. 5 functions generally the same as that of FIG. 1. The hand crank hoist 370 is used to move the rollable door 15 up and down generally similar to the movement in regular operating modes described in the previous embodiments. However, in this embodiment, moving of the door 15 is effected by pulling an endless element 380 and thus moving the door 15 by hand. However, with no motor, the fire door will need to be moved into the closed position with the aid of the pulsating clutch as described above. The system 365 incorporates the same clutch 85 and the same sprocket 30. Alternatively, the clutch 225 having the modified rotor 230 and a modified flex plate 245 can be incorporated in the system 365 of this embodiment.

It is to be understood that while the present invention has been described in terms of the clutches 85, 225 and the electronic controller 60 providing a pulsating on and off pattern, the invention includes non-pulsating configurations as well. For example, the clutch strength can be adjusted to provide a predetermined amount of slippage to slow the fire door 15 in its descent. Thus, the clutch 85, 255 could be applied relatively constantly during closing of the door 15. Alternatively, the force of the clutch 85, 255 could be made to vary over time to provide variable frictional engagement. Furthermore, patterns of engagement and disengagement of the clutches 85, 225 can be implemented that may not typically be considered to be "pulsating", and yet function to slow or stop the door 15 to provide a controlled descent and closure of the door 15 within the spirit and scope of the invention.

Figure 6B:
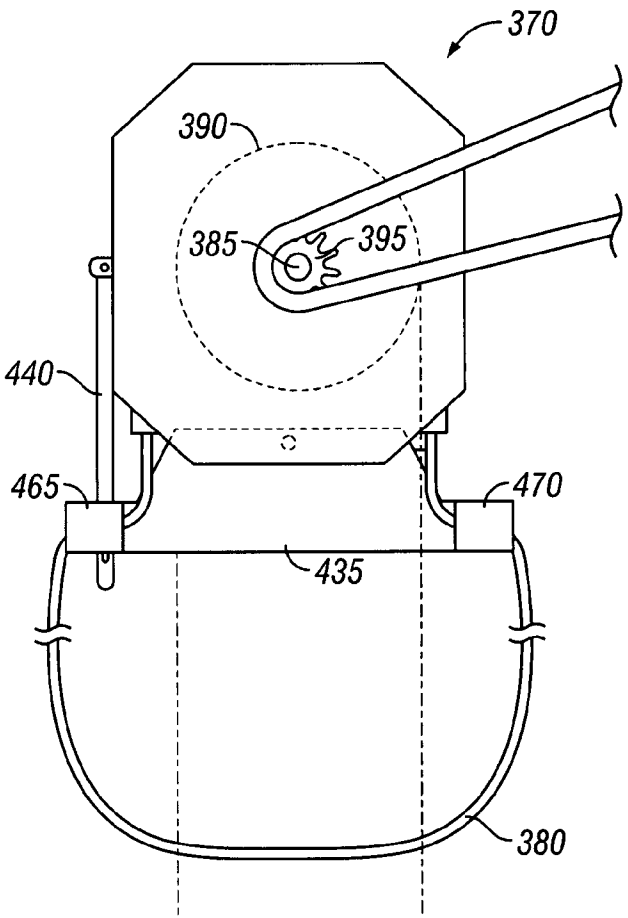
FIG. 6B is a front plan view of the hand crank hoist mechanism of FIGS. 5 and 6A.
Figure 6A:
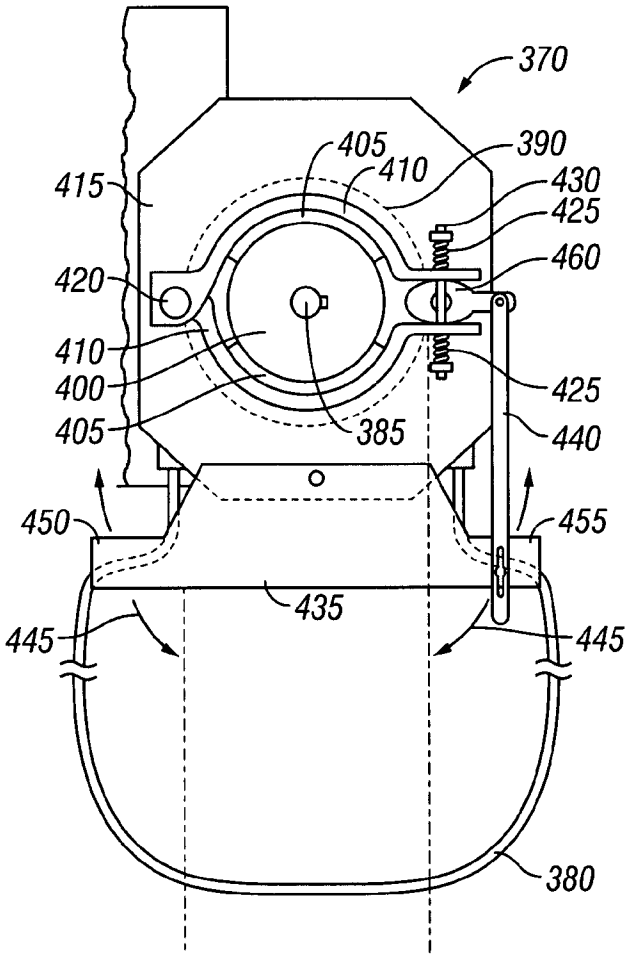
FIG. 6A is a rear plan view of the hand crank hoist mechanism of FIG. 5.

FIGS. 6A and 6B show respective rear and front views of the hand crank hoist 370 of FIG. 5. The details and advantages of the hand crank hoist 370 become apparent in FIGS. 6A and 6B. For example, the hand crank hoist 370 includes an axle 385 with an input pulley 390 in a central portion and a driving sprocket 395 at a first end. The hand crank axle 385 has a braking element 400 at a second end. As shown in FIG. 6A, the braking element 400 is regularly engaged by brake shoes 405. These brake shoes 405 are held in engagement with the braking element 400 by embracing arms 410 that are pivotally attached to a housing 415 by a pivot element 420. Springs 425 on a through shaft 430 hold the embracing arms 410 together and in engaging relation with the brake element 400. Thus, the input pulley 390 and the driving sprocket 395 are regularly held against rotational movement. (This holding feature emulates the holding provided by the gear reduction in the motorized system of FIG. 1.)

On the other hand, a bell crank 435 pivotally connected to a lower portion of the housing 415 and a linkage 440 function to selectively release the braking mechanism of the hand crank hoist 370. This is accomplished when a user pulls downwardly on the endless element 380. Pulling down on the endless element 380 causes the bell crank 435 to rotate as indicated by the arrows 445. This is so because the bell crank has guides 450, 455 that extend transverse to, and outwardly of, vertical lines that are tangent to the input pulley 390. The bell crank 435 is also caused to move because the endless element 380 would otherwise follow a path along those tangent lines. However, with the guides 450, 455 extending generally through those lines, the bell crank 435 is caused to rotate in a first direction when the endless element 380 is pulled on one side of the hand crank hoist, and in an opposite second direction when the endless element 380 is pulled downwardly on a diametrically opposite side of the hand crank hoist 370.

Rotation of the bell crank 435 in either direction actuates the linkage 440 that is connected to a cam element 460. The cam element 460 rotates and moves the embracing arms 410 away from each other by eccentric portions of the cam element 460. Thus, the brake shoes 405 are withdrawn from the brake element 400 and the input pulley 390 is free to rotate under the influence of the force applied by a user to the endless element 380. In this way, the hand crank hoist 370 of FIGS. 5 through 6B automatically releases the hand crank axle 385 when a user pulls on the endless element 380. It is to be understood that the linkage 440 and cam element 460 are only one mechanism by which the door resides. The second step can be that of resetting the system by pressing the open button or some other predetermined actuation element. An additional step of implementing a time delay can be provided between step 525 and 530 as a safeguard so that a predetermined period of time must elapse before resetting the system. This can be useful for allowing time for a fire department to have time to arrive and check the area before the system is reset. This time delay can be selectively implemented for only some alarm conditions, or can be implemented for all alarm conditions. The system can be reset by pressing the open button. On systems that have hand crank hoist drive mechanisms or that have doors that are manually raised, resetting the system can be accomplished by pulling the endless element, or by pressing a clutch release button, respectively. It should be noted that if the door is closed and an alarm condition is received in the controller, the door will remain closed until the alarm condition is removed and a signal to open the door has been received by the controller. Once the door is opened, the system is ready to be operated in normal running mode in accordance with the flow chart of FIG. 7.

Advantageously, the system can have another failsafe feature for a case in which a momentary signal indicating an alarm condition is received by the system. When such a momentary signal is received, the controller will automatically place the system into an alarm condition for a predetermined period of time and cause the door to close as set forth above. The predetermined time may be approximately thirty minutes or any other period sufficient to encourage a full review of system and any safety hazards. The system thus may be left in the alarm condition until the cause for the input signal can be determined and the problem can be resolved.

Figure 8A:
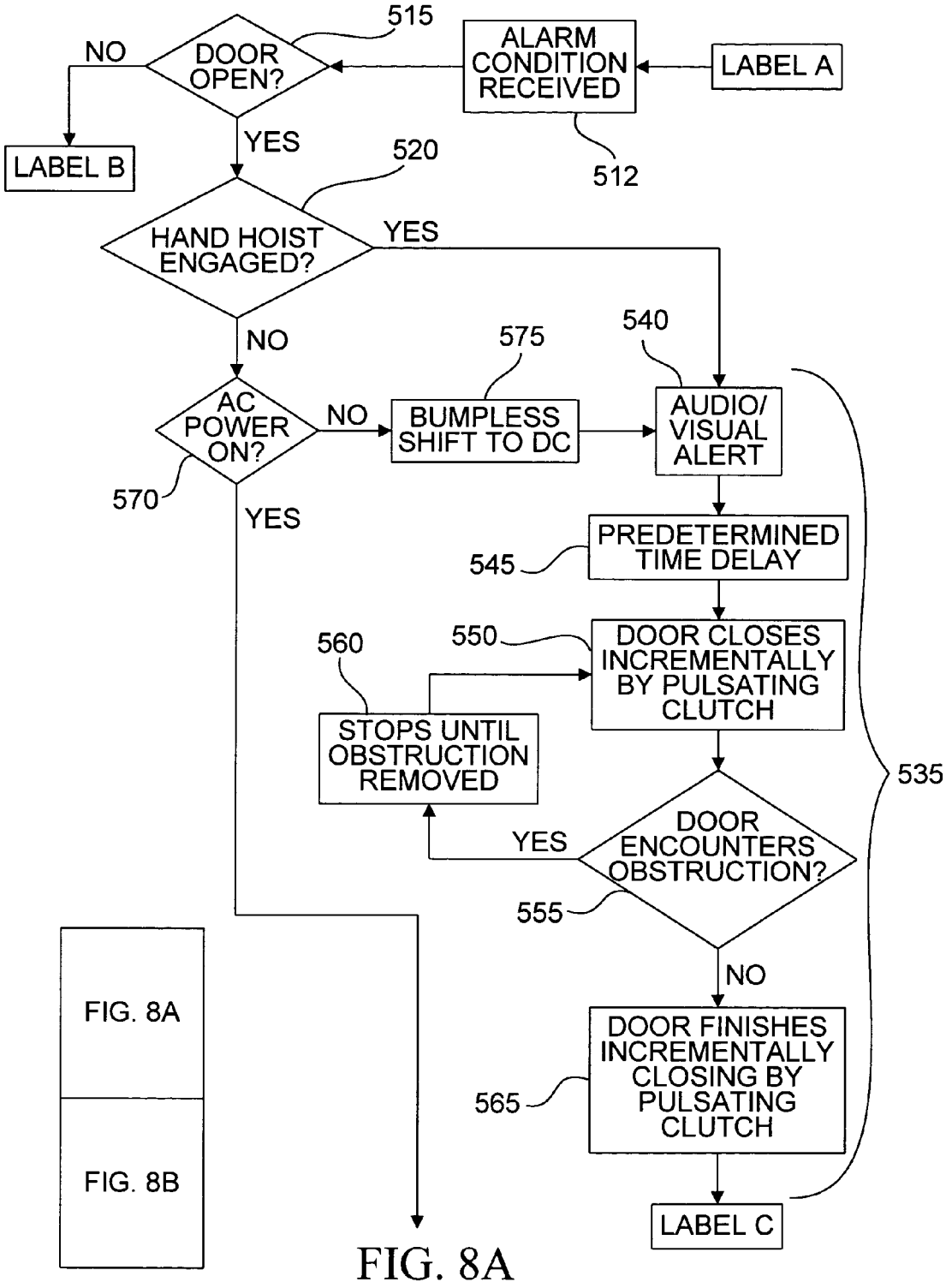
FIGS. 8A and 8B are a flow diagram depicting a method of operation for the fire door control system in an alarm condition.

When the controller checks to see if the hand hoist is engaged in step 520 near the top of FIG. 8A, the controller will receive a signal in response. If the hand hoist is engaged, then the controller will provide a first course of action 535. The first course of action includes a step 540 of initiating an audio visual alert in accordance with the particular alarm received, a step 545 of waiting a predetermined period of time, and then automatic brake release can be implemented. The linkage could be any of the variety of linkages that could incorporate levers, sliding mechanisms, or gears, for example.

FIG. 6B is a rear plan view of the hand crank hoist 370 of FIG. 6A and clarifies specific structure of the guides 450, 455. As shown, the guides 450, 455 comprise channels 465, 470 through which the endless element 380 passes. In this way inadvertent falling out of the endless element 380 from the guides 450, 455 is prevented, and a point of application of a force on the bell crank 435 at a position outwardly of vertical lines tangent to the input pulley 390 is assured. Thus, pulling vertically downward on the endless element 380 will always rotate the bell crank 435.

Figure 7:
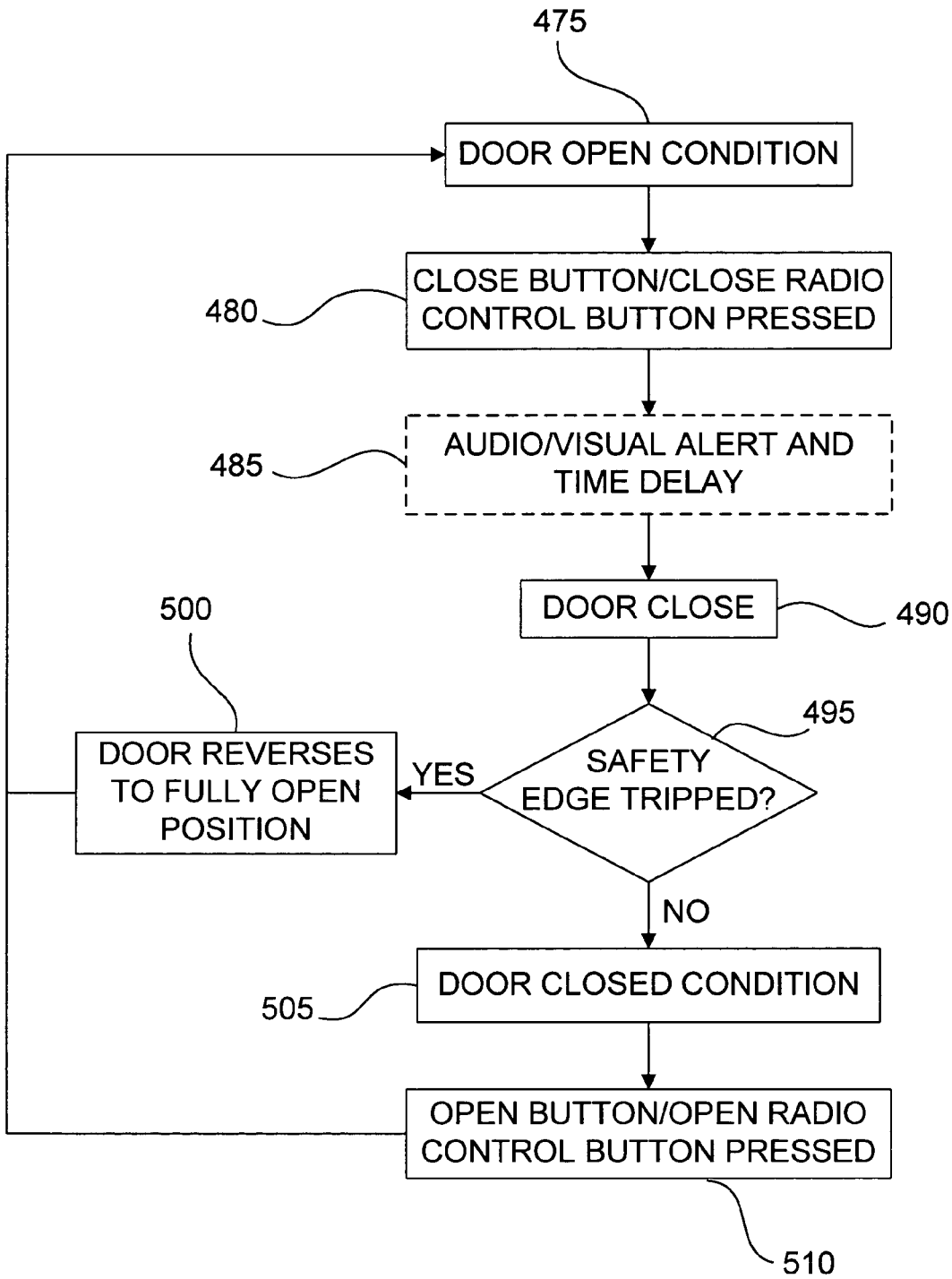
FIG. 7 is a flow diagram depicting a method of operating the door in a regular running mode.

FIG. 7 depicts a method of controlling a fire door control system in a normal running mode with no alarm condition present. As shown, the fire door system has a starting point with the door in an open condition at 475. A first step 480 includes pressing a close button. A second step 485, which is optional and is only implemented in some configurations of the system and method, includes initiating an audio and/or visual alert and a time delay before closing the door. This is beneficial for notifying persons in the vicinity that the door will be closing and for giving them a chance to get away from the door. A third step 490 includes closing the door. During the door closing condition, a controller awaits a signal from a safety sensor such as an edge trip sensor in a lower edge of a rollable door. Thus, a forth step 495 includes checking if a safety sensor has been tripped. If the safety sensor is tripped during the closing condition of the door an additional step 500 including reversing the door and moving the door to a fully open position is effected. In the fully opened condition 475 the door is ready for additional active input. On the other hand, if the safety edge is not tripped, the door continues to close until the door closed condition 505 is reached. In the door closed condition the door control system is ready for the fifth step 510 of opening the door by pressing an open button.

It is to be understood that in the method of controlling a fire door system under normal running conditions with no alarm condition present, a stop button could be pressed at any time to stop the door in its current position. In accordance with this method, the edge safety sensor is not active when the door is in a door opening condition. It is to be understood that the controller could be implemented as a mechanical, chemical, electrical, or combination controller. On the other hand, the controller for the present method is typically an electronic and/or electromechanical controller. Relatedly, the safety sensor can be implemented as an electromechanical contact strip run along a lower edge of the fire door so that when the lower edge contacts an obstruction between the fully up and the fully down positions, the contact strip is pressed and a signal is sent to the controller. Alternatively, the safety sensor can include one or more of a motion sensor, an optical sensor of the type that incorporates lasers or infrared beams, or a transponder type sensor. The safety sensor can be one of a plurality of safety sensors that can be located at positions other than on a lower edge of the fire door. These safety sensors are to be incorporated on doors that have power drive mechanisms, hand crank hoist drive mechanisms, as well as doors that are raised by hand.

Figure 8B:
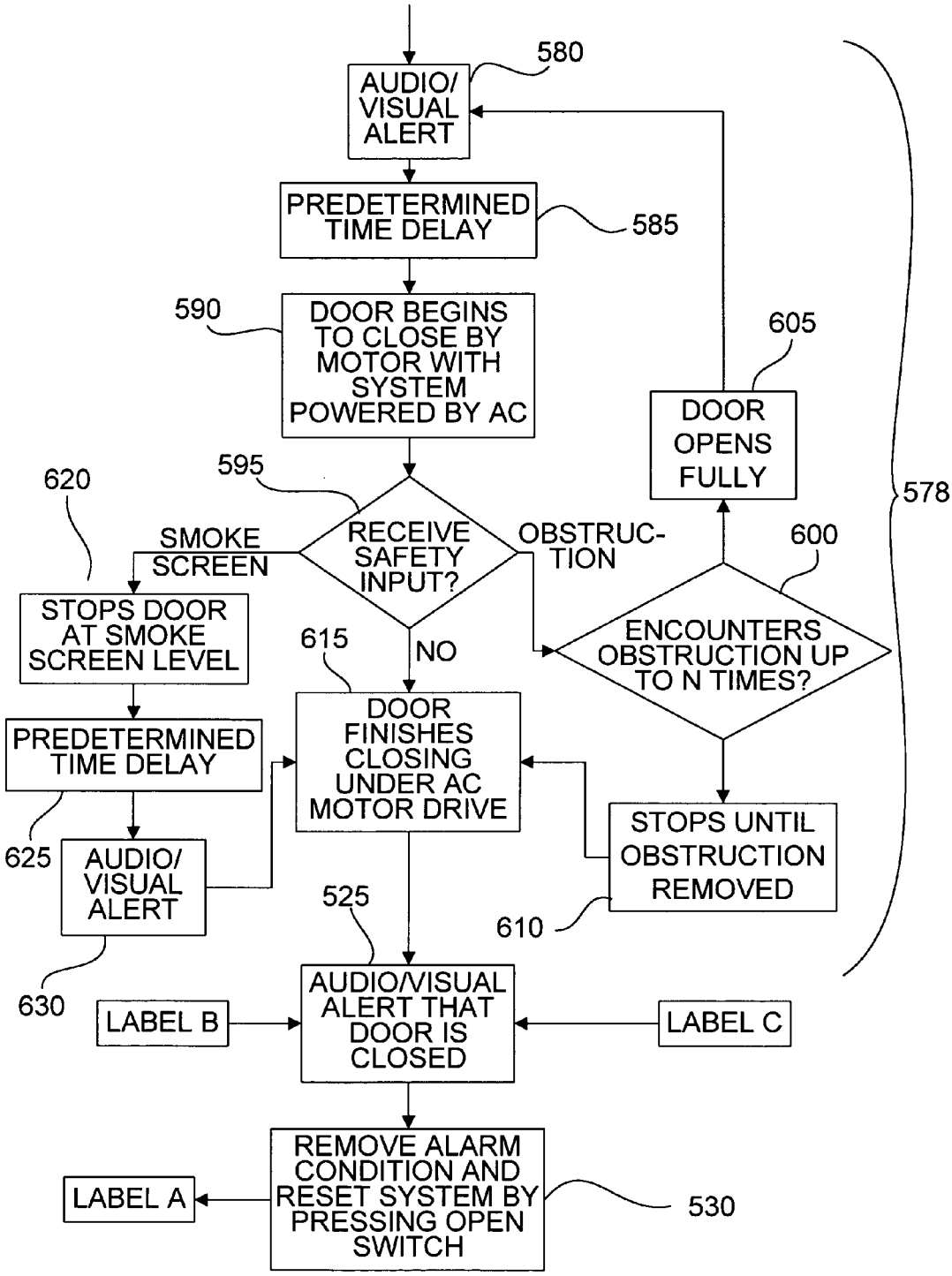

In accordance with the foregoing method of controlling a fire door control system for example, the fire door system can receive an alarm condition at any time during a normal running mode. FIGS. 8A and 8B are a flow chart depicting the method of controlling the fire door control system when an alarm condition 512 is received in the controller as shown in an upper portion of FIG. 8A. When according to step 512 an alarm condition signal is received in the controller, the controller initiates a step 515 of checking to see if the door is open. If the door is open, the controller implements a step 520 of checking to see if the hand hoist is engaged. If the door is closed, then the controller implements a step 525 of initiating an audio and/or visual alert that the door is closed, as shown near the bottom of FIG. 8B. After the alert indicating that the fire door is closed, the system is ready for a step 530 of removing the alarm condition and resetting the system. Thus, step 530 can represent two steps. The first step can be that of removing an alarm condition, such as in a fire alarm system in a building where the fire a step 550 of closing the door by pulsating a clutch to incrementally permit the door to fall. In this course of action, if the door encounters an obstruction as indicated at step 555, then the door will stop until the obstruction is moved as shown at step 560. Then the system returns to the step 550 wherein the door is pulsed closed by the clutch. The door will stop each time an obstruction is encountered as indicated at step 555. If no obstruction is encountered then the door finishes incrementally closing by the pulsating clutch as indicated at step 565. Once the door is fully closed, the controller initiates the audio and/or visual alert indicating that the door is closed as indicated at step 525 near the bottom of FIG. 8B.

Returning to the step 520 of checking to see if the hand hoist is engaged, it should be noted that if the hand hoist is not engaged then the controller checks to see if an AC or a primary source of power is on as indicated at step 570. If the AC power is not on, then the controller implements a step 575 of bumplessly shifting to DC power. Then, the first course of action 535 described above is implemented to bring the door down under pulsating control of the clutch.

It is to be understood that the clutch can be operated in other than a pulsating manner without departing from the spirit and scope of the present method. For example, the clutch can be adjusted to slip at a rate that controllably lowers the door. Other patterns of engaging the clutch including variable strength or continuous engagement can be implemented with the present method.

On the other hand with regard to the check at step 570 in the upper portion of FIG. 8A, if the AC power is on when the controller checks, then the controller implements a second course of action 578 utilizing primary or AC power as shown in FIG. 8B. The first step 580 of the second course of action is that the controller initiates an audio and/or visual alert. Then the controller implements a predetermined time delay as indicated at step 585. Next, the door begins to close by a motor with the system powered by primary or AC power as indicated at step 590. During this closing condition, the controller can receive a safety input as indicated at step 595. If the controller receives safety input that is a signal indicating that an obstruction has been encountered, then the controller checks to see if the obstruction has been encountered N or less times as indicated at step 600. If the obstruction has been encountered N or less times, then the controller sends the door back up to a fully opened position as indicated at step 605 and the system is returned to step 580 implementing an audio and/or visual alert. On the other hand, if the obstruction has been encountered more than N times, then the controller stops the door until the obstruction is removed as indicated at step 610. Once the obstruction has been removed, the controller causes the door to finish closing as indicated at step 615 and an alert is implemented accordingly as shown at step 525.

In another case, when according to step 595 the safety input is an automatic safety input for implementing a smoke screen feature, then the controller causes the door to be stopped at a smoke screen level as indicated at step 620. While the door is stopped at the smoke screen level, the controller provides a time delay for a predetermined period of time as indicated at step 625, during which time delay the controller initiates an audio visual alert that is specific to the smoke screen safety input as indicated at step 630. For example, the step of stopping the door at a smoke screen level can stop the door from approximately one third to approximately two thirds of a full closing distance. Alternatively, the smoke screen can be anywhere between a fully opened and a fully closed position. However, one purpose for the smoke screen feature is to stop or slow smoke from moving past the door while enabling disabled individuals to exit for a limited period of time before the door completely closes. After the time delay step 625 and audio/visual alert step 630, the controller causes the door to finish closing in accordance with step 615 and an alert is implemented indicating that the door is closed as indicated at step 525. In the case where no safety input is received the controller simply causes the door to finish closing as indicated at step 615 and an alert indicating that the door is closed is implemented.

As can be appreciated from FIGS. 8A and 8B and the method of controlling the fire door control system depicted therein, there are many paths to closing the door in an alarm condition. However, it is to be understood that once the door is closed, the alarm condition can be removed and the system can be reset by pressing an open switch associated with the system. It should be noted that the alarm condition can be engaged and removed in a broader system, such as an alarm system of a building in which the fire door resides. As described above, resetting the system can require an additional time delay after the fire condition has been implemented.

While the method shown in FIGS. 8A and 8B has been described in terms of systems having motor drive mechanisms and hand crank hoists, the method also applies to systems that do not have drive mechanisms. A main difference from what is shown in FIGS. 8A and 8B, is that the system without the drive mechanism will not be capable of sending the door back up when an obstruction is encountered. Another difference is that the door is not lowered by a drive mechanism in an alarm condition. Rather, the descent of the door is controlled by the clutch as described above. The clutch can be operated under primary or secondary power on a system that does not have a drive mechanism.

Figure 9:
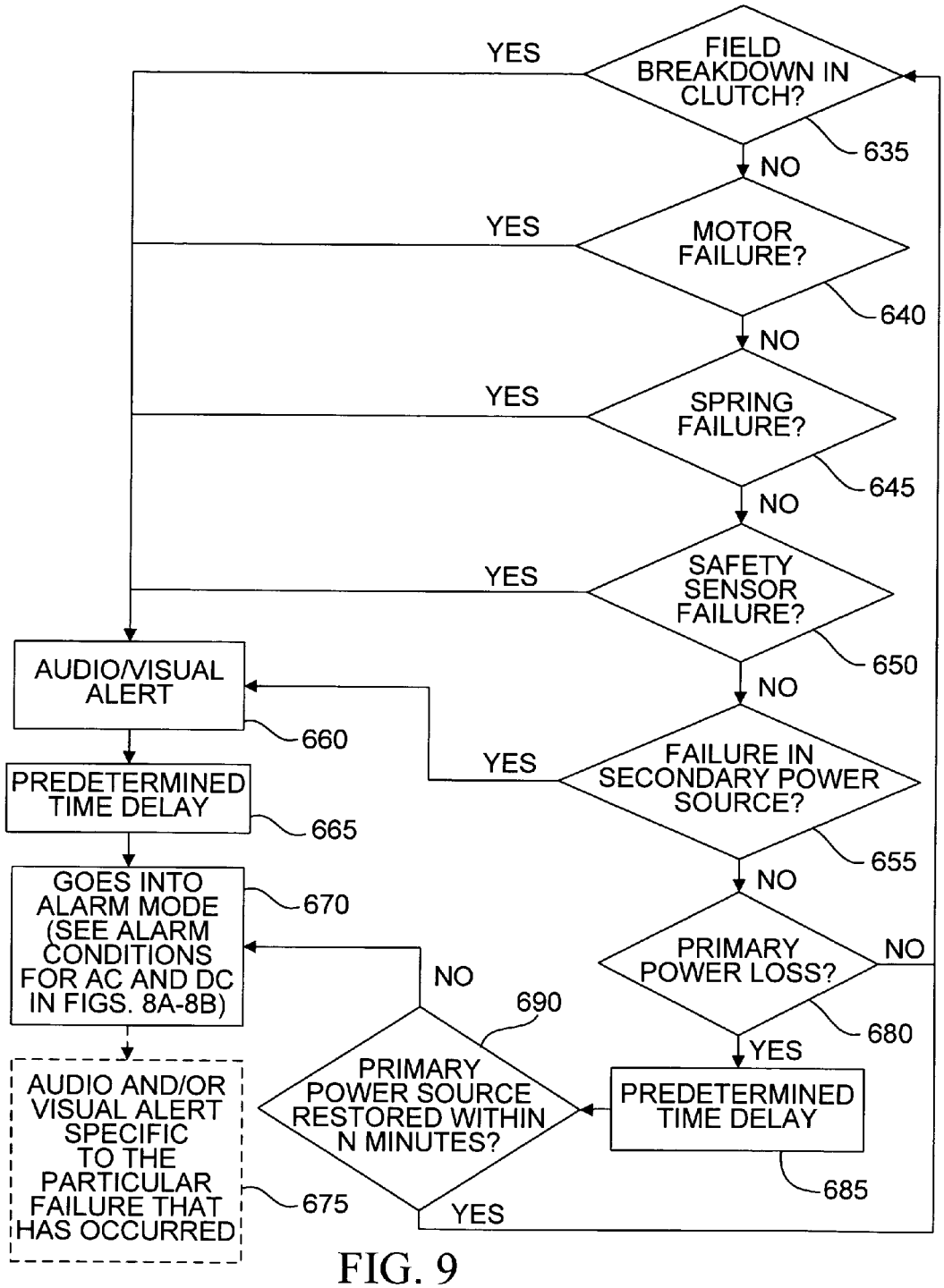
FIG. 9 is a flow diagram depicting the method of operating the fire door control system during failures in any of various elements of the system.

The foregoing method of controlling the fire door control system also has provisions for placing the system in a particular alarm mode that is specific to a failure in a particular element of the system as shown in the flow diagram in FIG. 9. During operation of the fire door control system, the controller periodically or constantly checks for failure in several elements of the system. For example, the controller checks for a field breakdown in the clutch as indicated at step 635 in FIG. 9. The controller can also check for one or more of motor failure, spring failure, safety sensor failure, and secondary power source failure as indicated by steps 640, 645, 650, and 655 respectively. If no failure is found in one of these elements, then the controller checks in a subsequent element. If failure is found in one of these elements then the controller initiates an audio and/or visual alert in accordance with the particular failure that has been discovered as indicated at step 660. Then a predetermined time delay specific to the particular failure is implemented as indicated at step 665. If the failure is not corrected in the predetermined time delay then the controller places the system into an alarm mode as indicated at step 670. The alarm mode indicated by step 670 in FIG. 9 corresponds to the alarm condition at step 512 in FIG. 8B. Thus, the alarm condition is treated in accordance with a first course of action 535 or a second course of action 578 as described above. However, in this case, the controller can initiate an audio and/or visual alert that is specific to the particular failure that has occurred as indicated at step 675. For example, when the controller receives a signal from the clutch sensor that the current in the coil of the clutch has experienced a rise greater than or equal to a predetermined level, then the clutch sensor sends a signal to the controller that there is a failure in the clutch. Then the alert could be provided as a voice alert stating that there is a field failure in the clutch and that the problem must be corrected before the door can be reset. It is to be understood that the controller can be configured accordingly to initiate corresponding alerts and require such correction for failures in any of the elements of the system. Correction of the failure is required in order for the system to be reset. It is also to be understood that the controller can have memory including data transmitted as corresponding audio alerts when loss of function is detected in any of the elements of the fire door control system.

If no failure is encountered in any of the elements described above then the controller checks to see if primary power has been lost as indicated at step 680. If the primary power has not been lost then the controller continues to periodically or constantly check for failure in the various components. If primary power has been lost then the controller implements a predetermined time delay as indicated at step 685. After the predetermined time delay the controller checks to see if the primary power source has been restored as indicated at step 690. If the primary power has been restored then the controller continues to periodically or constantly check for failures in the various elements as described above. If the primary power has not been restored within the predetermined period of time, then the controller places the fire door control system in the alarm mode as indicated at step 670.

The system and method can also include the feature described above that prompts a user to perform the required regulatory tests of the system periodically. Accordingly, the method of FIGS. 7–9 can also include sending a first test alert after a first predetermined test time period notifying the user that a test needs to be performed. This first alert can be implemented at or before approximately six months from installation or the last test performed on the system in accordance with FM or UL requirements. A second test alert can be implemented after a second predetermined test time period. The second test alert can be implemented by the electronic controller in conjunction with an imminent or simultaneous lock out mode from which the system cannot be released without performance of the test. For example, if the first test alert was ignored at the six month mark, the second alert could be implemented by the electronic controller at approximately one year from the previous test or installation of the system. The controller could also place the system in a lock out mode in which the alert is locked on until the system has been tested. Alternatively, other aspects of the system could be automatically actuated, such as the door closure for example, until the system is tested.

Alternatively, the system could automatically send out the alert(s) and test the door automatically at predetermined periods of time. If the system fails the tests, then an alert and/or lockout could be implemented indicating the test failure. The test alerts can be audio and/or visual alerts similar to those described above. It is to be understood that in some cases the order of various steps in the method described herein can be changed without departing from the spirit of the scope of the invention. For example, it should be understood that the steps of implementing an audio and/or visual alert can often be exchanged with the steps of implementing a predetermined time delay without loss of functionality of the method. Furthermore, it is to be understood that additional steps of checking for failures in other elements or other or failures in other aspects of the system and method can be implemented without departing from the spirit and scope of the invention.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, it is to be understood that while a primary power source is typically considered to refer to a source of AC power herein, the primary power source could be provided as DC power.

What is claimed is:

1. A method of testing and controlling a fire door system, the method comprising the steps of:

sending a first test alert under control of an electronic controller after a first predetermined period of time;

notifying a user by the first test alert that the system needs to be tested;

automatically initiating a lockout mode after a second predetermined period of time; and requiring by the lockout mode that the system be tested before the system is released from the lockout mode.

2. The method of claim 1, wherein the step of automatically initiating the lockout mode comprises:

sending a second test alert informing the user that the lockout mode is being initiated; and notifying the user by the second test alert that the system needs to be tested in order to be released from the lockout mode.

3. The method of claim 1, wherein the second predetermined period of time is less than or equal to one year and one day.

4. The method of claim 1, further comprising:

controlling a fire door by the electronic controller; and controlling the fire door by a clutch during alarm conditions.

5. A method of claim 4, further comprising controlling the fire door by a motor during alarm conditions when a primary power source is on, and wherein:

the step of controlling the fire door by the electronic controller further comprises controlling a fire door by the electronic controller in both of alarm conditions and non-alarm conditions when a primary power source is on; and the step of controlling the fire door by the clutch further comprises controlling the fire door by the clutch during alarm conditions when the primary power source is off.

6. The method of claim 4, wherein the steps of controlling the fire door further comprise actively opening, closing, or stopping the fire door by pressing a button operatively connected to the electronic controller.

7. The method of claim 4, further comprising:

receiving a signal in the electronic controller indicating one of the alarm conditions; and initiating a time delay of a predetermined reset delay period of time before which the system cannot be reset.

8. The method of claim 4, further comprising the steps of:

receiving a signal in the electronic controller indicating one of the alarm conditions; and initiating a warning alert to inform persons of the alarm condition and to warn them that the fire door will be closing.

9. The method of claim 4, further comprising the step of resetting the electronic controller by opening the fire door to a fully open position, wherein the step of resetting the electronic controller comprises removing an alarm condition for subsequent regular non-alarm operation of the fire door system.

10. The method of claim 4, further comprising periodically checking for a field breakdown in the clutch.

11. The method of claim 4, further comprising:

pulsating the clutch on and off to control a descent of the fire door in increments; and permitting the door to descend in increments corresponding to the pulsating of the clutch.

12. The method of claim 1, further comprising receiving a signal in the electronic controller indicating a loss of function in at least part of the system.

13. The method of claim 1, further comprising effecting a bumpless shift from primary power to secondary power.

14. The method of claim 1, further comprising periodically checking for a loss of primary power.

15. The method of claim 1, further comprising periodically checking for a failure in a secondary power source.

16. The method of claim 1, further comprising removing an alarm condition for subsequent regular non-alarm operation of the fire door system by resetting the electronic controller, wherein resetting the electronic controller comprises one of pressing a door opening button, pressing a clutch release button, and pulling a hand crank chain.

17. A method of testing and controlling a fire door system, the method comprising the steps of:

sending a first test alert under control of an electronic controller after a first predetermined period of time;

notifying a user by the first test alert that the system needs to be tested;

automatically initiating a lockout mode after a second predetermined period of time; and requiring by the lockout mode that the system be tested before the system is released from the lockout mode wherein a first predetermined period of time is in a range from three to nine months, the step of sending the first test alert further comprising sending the first test alert when the first predetermined period of time has lapsed so that the door can be tested every three to nine months.

* * * * *

UNITED STATES PATENT AND TRADEMARK OFFICE

CERTIFICATE OF CORRECTION

PATENT NO. : 6,924,730 B1
DATED : August 2, 2005
INVENTOR(S) : Evans

It is certified that error appears in the above-identified patent and that said Letters Patent is hereby corrected as shown below:

Column 12,
Line 58, please insert the following after "...460 are only one mechanism by which the…":
-- automatic brake release can be implemented. The linkage could be any of the variety of linkages that could incorporate levers, sliding mechanisms, or gears, for example.

Figure 6B is a rear plan view of the hand crank hoist 370 of Figure 6A and clarifies specific structure of the guides 450, 455. As shown, the guides 450, 455 comprise channels 465, 470 through which the endless element 380 passes. In this way inadvertent falling out of the endless element 380 from the guides 450, 455 is prevented, and a point of application of a force on the bell crank 435 at a position outwardly of vertical lines tangent to the input pulley 390 is assured. Thus, pulling vertically downward on the endless element 380 will always rotate the bell crank 435.

Figure 7 depicts a method of controlling a fire door control system in a normal running mode with no alarm condition present. As shown, the fire door system has a starting point with the door in an open condition at 475. A first step 480 includes pressing a close button. A second step 485, which is optional and is only implemented in some configurations of the system and method, includes initiating an audio and/or visual alert and a time delay before closing the door. This is beneficial for notifying persons in the vicinity that the door will be closing and for giving them a chance to get away from the door. A third step 490 includes closing the door. During the door closing condition, a controller awaits a signal from a safety sensor such as an edge trip sensor in a lower edge of a rollable door. Thus, a forth step 495 includes checking if a safety sensor has been tripped. If the safety sensor is tripped during the closing condition of the door an additional step 500 including reversing the door and moving the door to a fully open position is effected. In the fully opened condition 475 the door is ready for additional active input. On the other hand, if the safety edge is not tripped, the door continues to close until the door closed condition 505 is reached. In the door closed condition the door control system is ready for the fifth step 510 of opening the door by pressing an open button.

It is to be understood that in the method of controlling a fire door system under normal running conditions with no alarm condition present, a stop button could be pressed at any time to stop the door in its current position. In accordance with this method, the edge safety sensor is not active when the door is in a door opening condition. It is to be understood that the controller could be implemented as a mechanical, chemical, electrical, or combination controller. On the other hand, the controller for the present method is typically an electronic and/or electro-mechanical controller. Relatedly, the safety sensor can be implemented as an electro-mechanical contact strip run along a lower edge of the fire door so that when the lower edge contacts an obstruction between the fully up and the fully down positions, the contact strip is pressed and a signal is sent to the controller. Alternatively, the safety sensor can include one or more of a motion sensor, an optical sensor of the type that incorporates

UNITED STATES PATENT AND TRADEMARK OFFICE

CERTIFICATE OF CORRECTION

PATENT NO. : 6,924,730 B1
DATED : August 2, 2005
INVENTOR(S) : Evans

It is certified that error appears in the above-identified patent and that said Letters Patent is hereby corrected as shown below:

Column 12 (cont'd),
lasers or infrared beams, or a transponder type sensor. The safety sensor can be one of a plurality of safety sensors that can be located at positions other than on a lower edge of the fire door. These safety sensors are to be incorporated on doors that have power drive mechanisms, hand crank hoist drive mechanisms, as well as doors that are raised by hand.

In accordance with the foregoing method of controlling a fire door control system for example, the fire door system can receive an alarm condition at any time during a normal running mode. Figures 8A and 8B are a flow chart depicting the method of controlling the fire door control system when an alarm condition 512 is received in the controller as shown in an upper portion of Figure 8A. When according to step 512 an alarm condition signal is received in the controller, the controller initiates a step 515 of checking to see if the door is open. If the door is open, the controller implements a step 520 of checking to see if the hand hoist is engaged. If the door is closed, then the controller implements a step 525 of initiating an audio and/or visual alert that the door is closed, as shown near the bottom of Figure 8B. After the alert indicating that the fire door is closed, the system is ready for a step 530 of removing the alarm condition and resetting the system. Thus, step 530 can represent two steps. The first step can be that of removing an alarm condition, such as in a fire alarm system in a building where the fire --.

Column 13, line 33 to Column 14, line 47,
Please delete beginning with "...automatic brake release can…" and ending with "...alarm system in a building where the fire…".

Signed and Sealed this

Eighteenth Day of October, 2005

JON W. DUDAS
*Director of the United States Patent and Trademark Office*